US005152148A

United States Patent [19]

Crum et al.

[11] Patent Number: 5,152,148

[45] Date of Patent: Oct. 6, 1992

[54] PROPANE REMOVAL PROCESS

[75] Inventors: Fred S. Crum, Woodlands; James K. Dyer, Houston, both of Tex.

[73] Assignee: Liquid Energy Corporation, Harris County, Tex.

[21] Appl. No.: 715,402

[22] Filed: Jun. 14, 1991

[51] Int. Cl.[5] ..... F25J 3/06; F25J 3/02

[52] U.S. Cl. ..... 62/23; 62/24; 62/25; 62/27; 62/31; 62/32; 62/34

[58] Field of Search ..... 62/23, 24, 27, 29, 31, 62/32, 34, 25

[56] References Cited

U.S. PATENT DOCUMENTS

| | | | |
|---|---|---|---|
| 4,251,249 | 2/1981 | Gulsby | 62/28 |
| 4,464,190 | 8/1984 | Gulsby | 62/24 |
| 4,597,788 | 7/1986 | Apffel | 62/31 X |
| 4,698,081 | 10/1987 | Aghili | 62/32 X |
| 4,720,293 | 1/1988 | Rowles et al. | 62/31 X |
| 4,720,294 | 1/1988 | Lucadamo et al. | 62/31 |
| 4,738,699 | 4/1988 | Apffel | 62/31 X |
| 4,752,312 | 6/1988 | Prible | 62/25 |
| 4,770,683 | 9/1988 | Stothers | 62/25 |
| 4,889,545 | 12/1989 | Campbell et al. | 62/24 |

*Primary Examiner*—Henry A. Bennet
*Assistant Examiner*—Christopher B. Kilner
*Attorney, Agent, or Firm*—Gunn, Lee & Miller

[57] ABSTRACT

In a process for removing propane from a mixed liquid hydrocarbon stream, the depropanizer bottoms from a depropanizer are utilized to reflux the de-ethanizer. The process includes flowing the mixed liquid hydrocarbon stream through a de-ethanizer for separating ethane from the hydrocarbon stream and flowing the de-ethanizer bottoms to a depropanizer for separating the propane. The depropanizer bottoms are used as reflux for the de-ethanizer allowing the overhead temperature to be within range of aerial cooling. Propane recovery of greater than 92% is achievable at these conditions.

8 Claims, 2 Drawing Sheets

10
12
14
16
17
18
19
20
22
24
26
28
30
32
34
36
38
40
42
44
46
48
50
52
54
V 10
16
18
19
20
24
26
28
30
32
34
38
40
42
46
48
50
52
60
62
63
64
66
V 52
46
44
42
50
40
18
24
70
22
28
20
19
38
30
32
72
10
12
34

52
46
44
42
50
40
19
24
28
20
54
32
12
34
21

PROPANE REMOVAL PROCESS

BACKGROUND OF THE DISCLOSURE

The present invention is directed to a method for removal of selected products from a mixed liquid hydrocarbon stream, particularly, the removal of propane from a natural gas liquids (NGL) stream.

A clean environment, particularly clean air, is quickly becoming a major issue on the world scene today. Research has been targeted to the reduction of automobile emissions, a primary source of air pollution. In this search for an alternate fuel source, propane has become recognized as a clean burning efficient fuel for motor transportation use. Many local governments are required to find a replacement for diesel power in busses and other municipal transportations systems. As the search continues for a cleaner burning fuel, a number of processes in the prior art relate to the recovery of propane from natural gas. These processes, however, are not particularly efficient, having a propane recovery rate of only about 65% to 70% of the propane content of the natural gas. In conventional methods, propane is recovered from natural gas which is cryogenically processed by refrigerating the gas to a low temperature to effect separation of the propane and heavier components from the natural gas stream. This is a relatively expensive process, requiring refrigeration equipment, piping, vessels, compressors and utilities to operate the plant.

In U.S. Pat. No. 4,251,249 to Jerry G. Gulsby issued on Feb. 7, 1981, a low temperature process for separating propane from a natural gas stream is disclosed. Gulsby discusses the conventional methods of recovering propane and the heavier fractions from natural gas, including cryogenically processed natural gas which requires a temperature of about −60° F. to achieve a high efficiency of separation of the propane from the natural gas stream. To achieve the desired temperature range, a refrigerant such as Freon is utilized in the cryogenic process. Freon is very expensive and not environmentally desirable and therefore not practical for cooling large quantities of natural gas. Accordingly, conventional refrigeration techniques for recovering propane from natural gas have been too expensive to use, particularly for the relatively low recovery efficiency of propane.

In the process disclosed in U.S. Pat. No. 4,251,249 a low temperature fractioning process is utilized to separate condensible components from a hydrocarbon gas stream containing methane, ethane, propane and heavier hydrocarbon components. In that process, after dehydration, the inlet gas is successively passed through a series of refrigerations zones, for example heat exchangers, followed by a first separation stage to separate liquid condensate from the hydrocarbon gas. The gas stream is cooled further by expansion followed by a second separation stage to separate liquid containing $C_1$, $C_2$ and $C_3$ hydrocarbons from the gas which contains $C_1$ and $C_2$ hydrocarbons. Both streams are fed to a de-ethanizer fractioning column, with the liquid entering at a point intermediate the ends and the gas being utilized in a reflux condenser internal to the column above the point of entry of the liquid stream. The $C_1$, $C_2$ hydrocarbon gas in a reflux condenser in the column provides the refrigeration required to condense the propane and heavier constituents of the inlet gas and reject the methane and ethane.

Also disclosed in U.S. Pat. No. 4,251,249 is a process for recovering propane from natural gas disclosed in U.S. Pat. No. 3,292,380 issued Dec. 20, 1966, wherein gas under pressure is pre-cooled and expanded through a turbine to produce a gas condensate mixture at a low temperature. Another process in the prior art utilizes a conventional turbo-expander plant to initially reject the methane content of the natural gas stream, thereby yielding a high ethane and heavier hydrocarbon component recovery from the stream. The ethane and heavier component recovery products are then fed to a de-ethanizer to reject a large portion of the ethane, leaving sustantially only the propane and heavier gasoline components. Although this process requires refrigeration equipment, the de-ethanization may be carried out at +60° F. rather than −60° F. This process however is very expensive requiring additional equipment to accomplish the two-stage process as well as increased maintenance cost to keep the turbo-expander plant operating.

Techniques known in the prior art for separating ethane, propane and heavier hyrdrocarbons include fractional distillation employing de-ethanizers, depropanizers, debutanizers, iso- and normal-butane splitters and depropanizers in a cascade configuration. In order to achieve the same degree of propane removal as described in the present invention, prior art methods would require either of the following two configurations: (1) a de-ethanizer tower whose bottom product, principally propane and heavier components, is fed to a depropanizer and reflux for the de-ethanizer tower generated by condensing all or part of the tower overhead vapor product with a suitable cooling medium, commonly refrigerant. The depropanizer would then separate the propane as the overhead product, and the butane and heavier components as the bottom product; or (2) a depropanizer tower whose overhead product, principally ethane and propane, is fed to a de-ethanizer, and reflux for the depropanizer tower would be generated by condensing all or part of the tower overhead with a suitable cooling medium, commonly air or water. The bottoms from the depropanizer would comprise butane and heavier components. The net overhead product from the depropanizer tower would be fed to the de-ethanizer tower which then separates the ethane as the overhead product and the propane as the bottom product. Reflux for the de-ethanizer tower would be generated by condensing all or part of the tower overhead vapor product with a suitable cooling medium, commonly refrigerant.

Other techniques and processes are known in the prior art for separating propane and heavier hydrocarbons from a natural gas stream. These processes however have not yet been widely used because of the substantial expense required to operate such facilities, particularly when the propane recovery efficiency is low where a high rejection of ethane is attained. Accordingly, it is an object of the present invention to provide a process for the separation of propane from a mixed liquid hydrocarbon stream at substantially ambient temperature and high propane recovery efficiency.

SUMMARY OF THE INVENTION

The present invention provides a process for removal of propane from a mixed liquid hydrocarbon stream in the absence of refrigeration. In particular, the present invention provides a process for the separation of propane and heavier components from a mixed liquid hydrocarbon stream utilizing the depropanizer bottoms as reflux to the de-ethanizer tower allowing the overhead temperature to be within range of aerial cooling. Propane recovery of greater than 92% is achievable utilizing the process of the invention. In cooler climates, lower ambient temperatures will provide higher recovery of propane from the mixed liquid hydrocarbon stream.

BRIEF DESCRIPTON OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
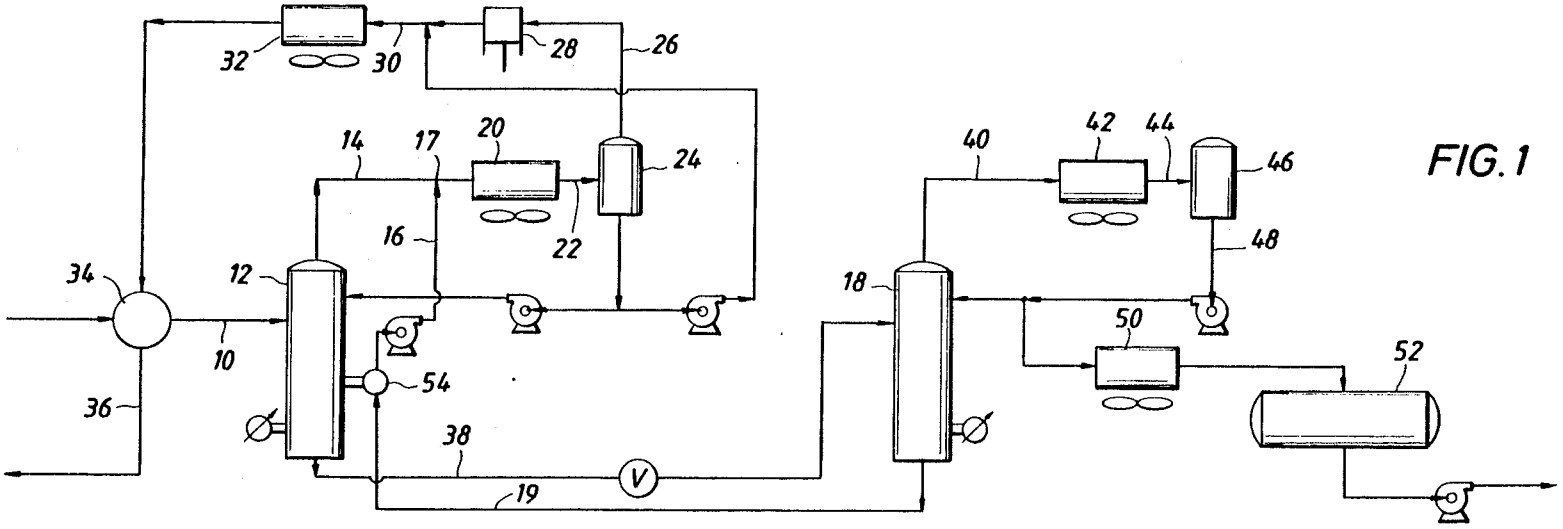
FIG. 1 is a schematic illustration of the preferred embodiment of the invention.

Referring first to FIG. 1, the process of the present invention will be described with regard to the fractionation or separation of propane from a mixed liquid hydrocarbon stream produced by a high ethane recovery gas processing plant. It is understood, however, that the process of the invention is not limited to removal of propane, but may be equally applicable to fractionation or separation of other constituents from a mixed liquid hydrocarbon stream.

Referring now to FIG. 1, an NGL feed is pre-heated by depropanized product prior to being fed through line 10 to the de-ethanizer column 12. The de-ethanizer column 12 is a reboiled, presaturated absorber which separates ethane from the NGL feed. Ethane and some of the heavier components exit the de-ethanizer column 12 through line 14 and are mixed with butane and heavier components. The butane mixture stream is received from the bottoms of the depropanizer column 18 through pipe 16 which connects to the line 14 at 17. The combined liquid hydrocarbon stream is passed through a condenser 20 and cooled to approximately 120° F. From the condenser 20, the combined liquid hydrocarbon stream flows through line 22 to a reflux accumulator 24 where the liquids are separated. The vapor stream is primarily ethane and flows from the reflux accumulator 24 into a small vapor compressor 28 where it is compressed to approximately 520 psig. The liquid in the reflux accumulator 24 constitutes primarily butanes and heavier components and whatever ethane is absorbed from the ethane vapor. The net overhead liquid in the reflux accumulator 24 is pumped up to 520 psig and combined with the ethane vapor stream. This mixture of ethane and liquid is flowed through line 30 to a condenser 32 where it is condensed and used to pre-heat the incoming mixed liquid hydrocarbon feed stream in the heat exchanger 34 and thereafter directed to a storage facility through line 36. The remaining presaturated liquid in the reflux accumulator 24 is used to reflux the de-ethanizer column 12.

The bottoms of the de-ethanizer column 12 contain propane and heavier components. These components are fed to a depropanizer column 18 through line 38. The propane in the depropanizer column 18 is removed via line 40 and passed through a reflux condenser 42. The cooled propane is flowed through line 44 to an accumulator 46. The condensed propane flows from the accumulator 46 through line 48 to a condenser 50 for further cooling and is then flowed to a storage tank 52 for subsequent delivery to market.

The bottoms of the depropanizer column 18 consists of heavier components such as butane, pentane, hexane and heptane. The liquid mixture from the bottoms of the depropanizer column 18 is flowed through line 19 to be used as the reflux to the de-ethanizer column 12. The heat from the depropanizer bottoms stream is partially recovered by passing the depropanizer bottoms mixture through a side heater 54 for side reboiling the de-ethanizer column 12. In utilizing the depropanizer bottoms mixture as reflux to the de-ethanizer column 12, the process of the present invention provides an overhead temperature for the de-ethanizer column 12 within the range of aerial cooling. Propane recovery of approximately 92% is achievable at these conditions. In winter time or in climates where the ambient temperature is lower, a higher recovery percentage of propane will be achieved.

Figure 2:
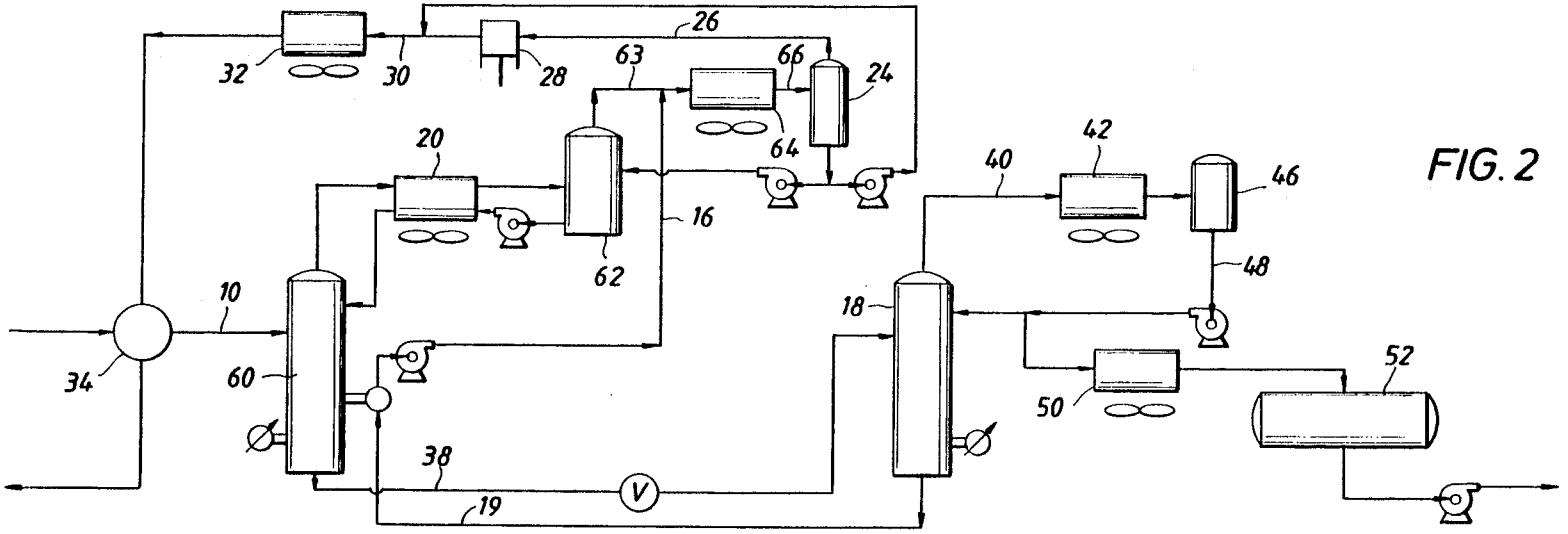
FIG. 2 is a schematic illustration of an alternate embodiment of the invention featuring two de-ethanizer towers.

Many variations may be made to the process of the invention to meet specialized needs. In FIG. 2, a high recovery variation is shown. The alternate embodiment of FIG. 2 splits the de-ethanizer column into two towers 60 and 62 so that some heat of absorption can be removed. Greater propane recovery is achieved because propane is removed from the mixed liquid hydrocarbon stream at a lower temperature. The process plant configuration shown in FIG. 2 is substantially similar to the plant shown in FIG. 1 and therefore like reference numerals have been used to identify like components. It will be observed that the ethane and some of the heavier components exiting the top of the de-ethanizer tower 60 are directed through the condenser 20 and provide the feed for a second de-ethanizer tower 62. The ethane exits the tower 62 through line 63 and passes through a second condenser 64. Prior to entry into the condenser 64, the ethane gas mixture is combined with the heavier stream from the depropanizer bottoms received through line 16 to form a combined stream which is passed through the condenser 64 and flowed through line 66 to the accumulator 24. From accumulator 24, the ethane vapor is flowed through line 26 to the compressor 28 and thereafter used to pre-heat the inlet feed at heat exchanger 34 prior to leaving the process as previously described. The remaining presaturated liquid in the accumulator 24 is used to reflux the de-ethanizer tower 62, and the bottoms thereof are used to reflux the de-ethanizer tower 60 so that greater propane recovery is achieved.

Figure 3:
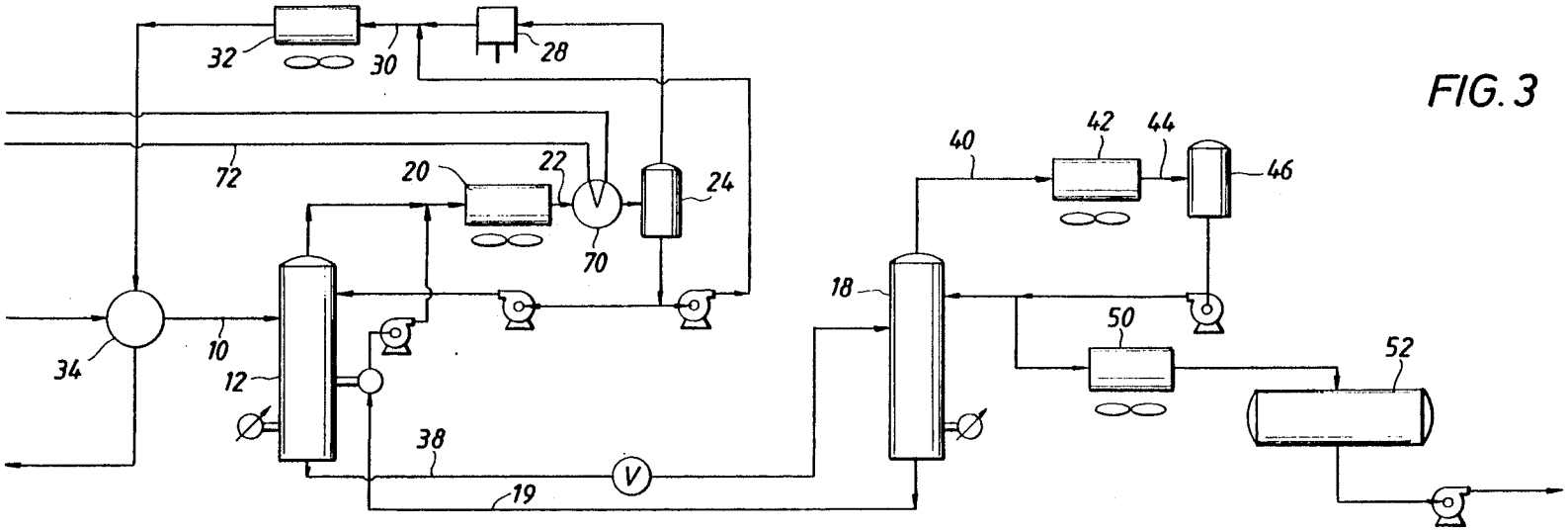
FIG. 3 is a schematic illustration of yet another alternate embodiment of the invention featuring propane removal from a feed received from an adjacent cryogenic gas plant.

Referring now to FIG. 3, a cold feed from an adjacent cryogenic gas plant is used to sub-cool the combined stream flowing through line 22 between the condenser 20 and the reflux accumulator 24. The cryogenic feed is flowed through a heat exchanger 70 which cools stream 22 and warms the cryogenic feed. Outflow from the heat exchanger 70 is flowed via line 72 through the heat exchanger 34 for cooling the inlet mixed liquid feed to the de-ethanizer 12. High efficiency separation of propane is attained at lower temperatures. Passing the combined stream through a cryogenic heat exchanger will lower the temperature of the combined stream to achieve a higher recovery of propane.

Figure 4:
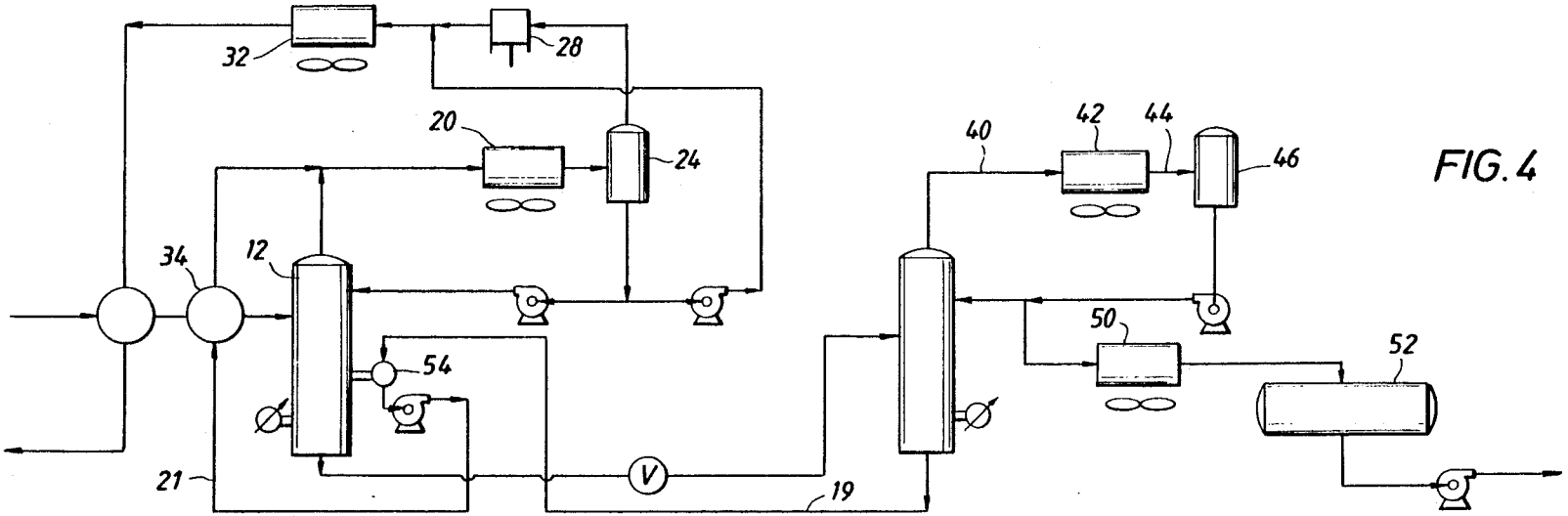
FIG. 4 is a schematic illustration of yet another alternate embodiment of the invention featuring higher heat recovery from the depropanizer bottoms stream.

In the process of FIG. 4, heat from the depropanizer bottoms stream is utilized to lower the energy consumption in the de-ethanizer column 12. The liquid mixture from the bottoms of the depropanizer column 18 is flowed through line 19 and the side heater 54. For side reboiling the de-ethanizer column 12. The depropanizer bottoms mixture is then flowed through the condenser 20 via line 21 and cooled to approximately 120° F. Thereafter, the mixture is refluxed in the manner previously described in the process of the plant shown in FIG. 1. While the process of FIG. 1 of the de-ethanizer reboiler, the percentage of propane recovery is also slightly reduced.

The process of the present invention can produce propane cheaply with little effect on the environment. A propane recovery efficiency of 90% or greater can be achieved, with rejection of 90% or more of the ethane content of the inlet mixed liquid hydrocarbon stream. Such recovery is achieved by using the depropanizer bottoms as reflux to the de-ethanizer tower allowing the overhead temperature to be within the range of aerial cooling. The process of the present invention eliminates the need for a refrigeration compressor, condenser, chiller and the associated piping, vessels and utilities.

Although the above description is directed to the preferred embodiment of the invention and relates to processing of a mixed liquid hydrocarbon stream, it will be appreciated by those skilled in the art that the process and the apparatus for carrying out the process will admit to variations and modification, and will be applicable to the processing of hydrocarbons, whether gas or liquid, and to the recovery of components other than propane. It is understood that other and further embodiments of the invention may be devised without departing from the basic scope thereof, and the scope thereof is determined by the claims which follow.

What is claimed is:

1. A process for removing propane from a mixed liquid hydrocarbon stream, comprising the steps of:

a) flowing a mixed liquid hydrocarbon stream to de-ethanizer means;

b) separating an ethane gas mixture, from the mixed liquid hydrocarbon stream;

c) removing the ethane gas mixture from said de-ethanizer means;

d) mixing said ethane gas mixture with a butane and heavier hydrocarbon components stream to form a combined stream of ethane, butane and heavier hydrocarbons;

e) cooling said combined stream and flowing said combined stream to reflux accumulator means wherein vapor and liquids are separated from said combined stream;

f) flowing said liquid from said reflux accumulator to said de-ethanizer means for refluxing said de-ethanizer means and accumulating a hydrocarbon at the bottom thereof;

g) flowing said hydrocarbon mixture from the bottom of said de-ethanizer means to depropanizer means; and h) separating the propane from said hydrocarbon mixture and flowing the hydrocarbon bottoms liquid mixture of said depropanizer means to said reflux accumulator for refluxing said de-ethanizer means for providing the necessary cooling for recovering propane as a specification product.

2. The process of claim 1 wherein said inlet feed is pre-heated by an ethane vapor mixture passing through a heat exchanger.

3. The process of claim 1 wherein said combined stream is cooled to approximately 120° F.

4. The process of claim 1 wherein heat from the depropanizer bottoms liquid mixture is partially recovered and used to side reboil said de-ethanizer means.

5. The process of claim 1 including these steps of using said depropanizer bottoms as reflux to said de-ethanizer means and allowing the overhead temperature of said de-ethanizer means to be in the range of aerial cooling for achieving a propane recovery efficiency of greater than 90%.

6. The process of claim 1 including the steps of:

a) initially flowing said mixed liquid hydrocarbon stream into first de-ethanizer means;

b) separating an ethane gas mixture from the mixed liquid hydrocarbon stream;

c) removing the ethane gas mixture from said first de-ethanizer means and passing said ethane gas mixture through a condenser to a second de-ethanizer means;

d) separating a second ethane gas mixture comprising ethane and heavier hydrocarbon components from the first ethane gas mixture;

e) removing said second ethane gas mixture from said second de-ethanizer means;

f) mixing said second ethane gas mixture with a butane and heavier hydrocarbon components stream to form a combined stream of ethane, butane and heavier hydrocarbons;

g) cooling said combined stream and flowing said combined stream to reflux accumulator means wherein vapor and liquids are separated from said combined stream;

h) flowing said liquid from said reflux accumulator to said second de-ethanizer means for refluxing said second de-ethanizer means and accumulating a hydrocarbon mixture at the bottom thereof;

i) flowing said second de-ethanizer means bottoms through condenser means for refluxing said first de-ethanizer means and accumulating a second hydrocarbon mixture at the bottom thereof;

j) flowing said second hydrocarbon mixture from the bottom of said first de-ethanizer means to depropanizing means; and separating the propane from said second hydrocarbon mixture and flowing the depropanizer bottoms liquid mixture of said depropanizer means to said reflux accumulator for refluxing said second de-ethanizer means for providing the necessary cooling for recovering propane as a specification product.

7. A process for removing propane from a mixed liquid hydrocarbon stream, comprising the steps of:

a) flowing a mixed liquid hydrocarbon stream to de-ethanizer means;

b) cooling said mixed liquid hydrocarbon stream by flowing through a cryogenic heat exchanger prior to flowing said mixed liquid hydrocarbon stream to said de-ethanizer means;

c) separating an ethane gas mixture from the mixed liquid hydrocarbon stream;

d) removing the ethane gas mixture from said de-ethanizer means;

e) mixing said ethane gas mixture with a butane and heavier hydrocarbon components stream to form a combined stream of ethane, butane and heavier hydrocarbons;

f) cooling said combined stream and flowing said combined stream to reflux accumulator means wherein vapor and liquids are separated from said combined stream;

g) flowing said liquid from said reflux accumulator to said de-ethanizer means for refluxing said de-ethanizer means and accumulating a hydrocarbon at the bottom thereof;

h) flowing said hydrocarbon mixture from the bottom of said de-ethanizer means to depropanizer means; and i) separating the propane from said hydrocarbon mixture and flowing the hydrocarbon bottoms liquid mixture of said depropanizer means to said reflux accumulator for refluxing said de-ethanizer means for providing the necessary cooling for recovering propane as a specification product.

8. The process of claim 7 including the step of sub-cooling said combined stream by passing said combined stream through coil means prior to flowing said combined stream to said reflux accumulator.

* * * * *